United States Patent [19]

LeMoine

[11] Patent Number: 4,864,914

[45] Date of Patent: Sep. 12, 1989

[54] BLOWOUT PREVENTER BOOSTER AND METHOD

[75] Inventor: Joseph L. LeMoine, Brookshire, Tex.

[73] Assignee: Stewart & Stevenson Services,Inc., Houston, Tex.

[21] Appl. No.: 201,511

[22] Filed: Jun. 1, 1988

[51] Int. Cl.[4] ..... F15B 13/04

[52] U.S. Cl. ..... 91/29; 60/563; 251/1.3; 417/226

[58] Field of Search ..... 251/1.1, 1.2, 1.3; 417/225, 226, 227; 91/28, 29, 519; 60/563

[56] References Cited

U.S. PATENT DOCUMENTS

| | | | |
|---|---|---|---|
| 1,888,990 | 11/1932 | Kurath | 60/563 |
| 2,030,966 | 2/1936 | Crane et al. | 60/429 |
| 2,481,991 | 9/1949 | Ernst | 60/537 |
| 2,608,059 | 8/1952 | Kux | 60/563 |
| 2,740,258 | 4/1956 | Weber | 60/547.1 |
| 3,407,601 | 10/1968 | Beck | 417/226 X |
| 4,073,543 | 2/1978 | Resch | 91/28 X |
| 4,317,557 | 3/1982 | Orr | 251/1.3 X |
| 4,349,041 | 9/1982 | Bates | 137/1 |
| 4,509,405 | 4/1985 | Bates | 251/1.1 |
| 4,512,151 | 4/1985 | Yamatami | 92/159 X |

*Primary Examiner*—Edward K. Look

*Attorney, Agent, or Firm*—Fulbright & Jaworski

[57] ABSTRACT

A hydraulic control circuit and method of operating a blowout preventer having a two-way hydraulic piston and cylinder assembly including an open and close port. An adjustable hydraulic supply is connected to a control valve which is in turn connected to the open and close ports. A pressure booster having an input and an output is connected to the close port and a control circuit is connected to the input of the booster and to the close port for actuating the booster and also blocking flow from the control valve to the closed port when the hydraulic supply increases to a predetermined value.

7 Claims, 1 Drawing Sheet

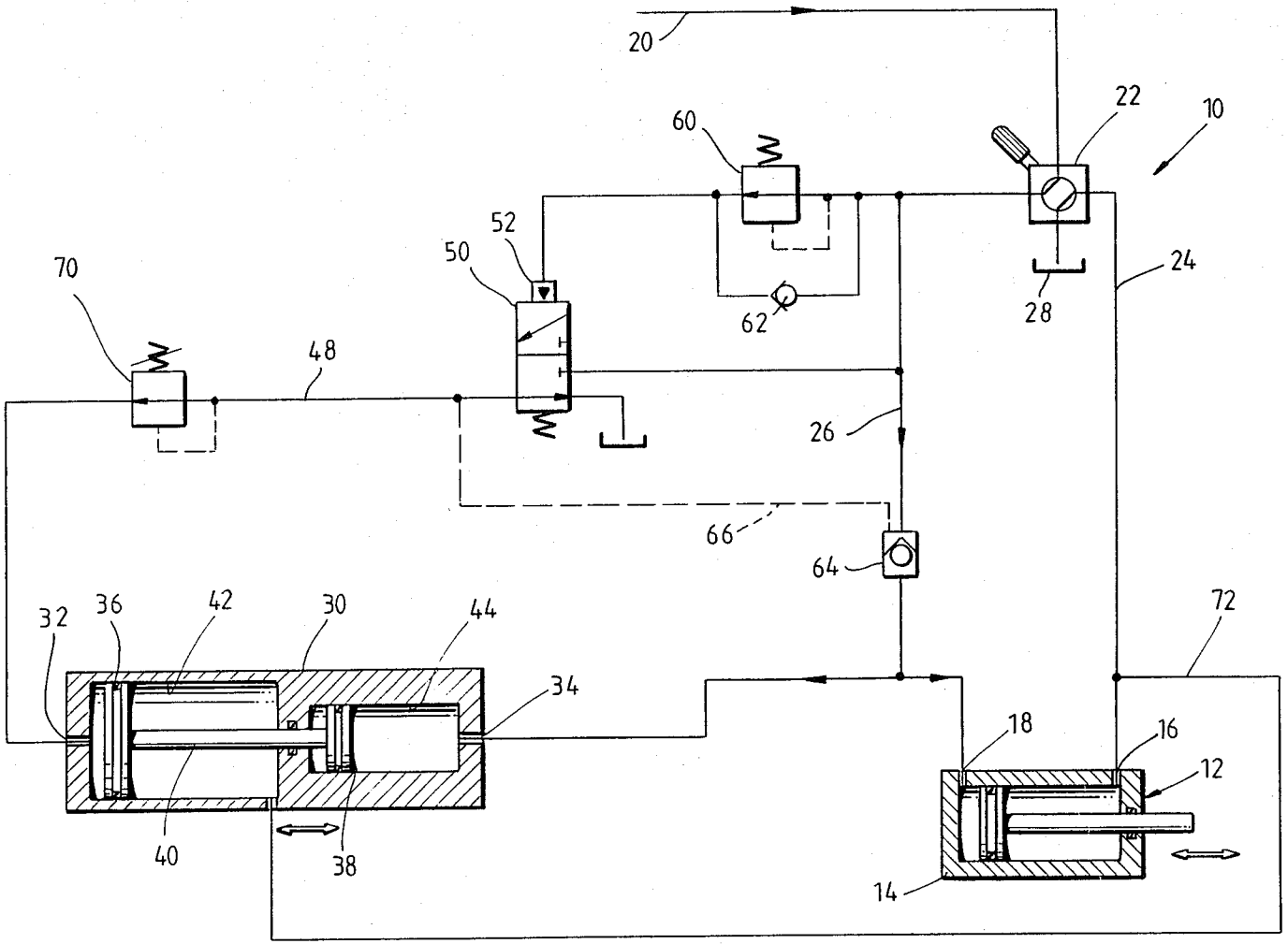
10
22
24
28
72
12
16
18
14
20
60
62
26
64
66
52
50
34
44
38
30
48
42
40
36
32
70

BLOWOUT PREVENTER BOOSTER AND METHOD

BACKGROUND OF THE INVENTION

It is well known to operate a blowout preventer having a two-way hydraulic piston and cylinder assembly including an open and close port by means of a control valve connected to a hydraulic supply. However, it is sometimes desirable or even necessary to provide greater closing forces, particularly in the case of shear ram type blowout preventers where the rams must cut and sever pipe in a well. For example, normally some types of blowout preventers may be operated at 1500 psi. However, to insure that shear rams will positively cut through pipe they may require as much as 5000 psi operating pressure.

The present invention is directed to a hydraulic control circuit and method for operating a blowout preventer by boosting the pressure above that provided by the normal supply pressure.

SUMMARY

The present invention is directed to a hydraulic control circuit for operating a blowout preventer having a two-way hydraulic piston and cylinder assembly including an open and close port. An adjustable hydraulic supply is provided and a control valve is connected between the hydraulic supply and the open and close ports. A pressure intensifier or booster is provided having an input and an output with the output connected to the close port for providing an increased closing pressure at the close port. Valve means are connected to the input of the booster or intensifier and to the close port for actuating the intensifier and blocking flow from the control valve to the close port when the hydraulic supply pressure increases to a predetermined value.

Still a further object of the present invention is wherein the valve means includes a normally closed valve means connected to the input to the booster or intensifier and the normally closed valve means is openable upon receiving a predetermined hydraulic pressure, and a pilot operated check valve is connected between the control valve and the close port.

Still a further object of the present invention is wherein the pressure booster or intensifier includes a first piston connected to a second smaller piston in which the pistons are movable in separate cylinders. The first piston is connected to the input and the second piston is connected to the output.

Yet still a further object of the present invention is the provision of a relief valve connected to the input to the intensifier for limiting the pressure applied to the close port.

Other and further objects, features and advantages will be apparent from the following description of a presently preferred embodiment of the invention, given for the purpose of disclosure and taken in conjunction with the accompanying drawing.

BRIEF DESCRIPTION OF THE DRAWING

The drawing is a schematic diagram of the hydraulic control circuit of the present invention for operating a blowout preventer.

DESCRIPTION OF THE PREFERRED EMBODIMENT

While the present invention will be described as an apparatus and method for operating a blowout preventer having shear rams, for purposes of illustration only, it will be understood that the present invention can be used with blowout preventers having other types of rams. In addition, it will be understood that while exemplary values of pressures are given, other pressure values may be utilized.

Referring now to the drawing, the reference numeral 10 generally indicates the hydraulic control circuit of the present invention for operating a blowout preventer such as a blowout preventer 12 having a two-way hydraulic piston and cylinder assembly 14 which includes an open port 16 and a close port 18. It will be understood that only one side of the blowout preventer 12 is shown as a blowout preventer is conventional and would include another hydraulic piston and cylinder assembly 14 on the opposite side of a well. Blowout preventer 12 may include various types of closing means such as pipe rams, annular preventers or shear rams (not shown).

A hydraulic fluid supply 20 is provided which in the present invention is adjustable, for example, from 1500 psi to 3000 psi for reasons which will be more fully discussed hereinafter. A control valve 22 is provided which can be operated to transmit hydraulic fluid from the line 20 to either the open port 16 or the close port 18 through open line 24 and close line 26, respectively. The control valve 20 is shown in position for transmitting hydraulic fluid from line 20 to the close port 18 for moving the BOP 14 to the closed position while venting fluid from the open port 16 through the line 24 to a vent sump 28. The valve 22 may also be placed in an intermediate position in which fluid from the hydraulic supply 20 is blocked from both the open port 16 and the close port 18.

However, while the range of pressures available in the hydraulic supply line 20, for example 1500 to 3000 psi, may be sufficient for operation of some types of blowout preventers, the pressures available may not be sufficient for a typical shear ram blowout preventer 12 for shearing pipe where the required pressure may be between 3000 and 5000 psi. The present invention is directed to a hydraulic control circuit wherein the required pressure for actuating a blowout preventer such as a shear ram type, can automatically be provided with between 3000 and 5000 psi, upon increasing the pressure in the hydraulic supply line 20.

A pressure booster or pressure intensifier 30 is provided having an input 32 and an output 34. The pressure booster 30 may include a first piston 36 which is connected to a second smaller piston 38 by a piston rod 40. Each of the pistons are movable in separate cylinders. Thus, the piston 36 is movable in a cylinder 42 and the piston 38 is movable in a cylinder 44. The pressure booster 30 intensifies or boosts pressure in response to pressure applied to the inlet 32 by providing an increased pressure at the outlet 34. The magnitude of the pressure increase depends upon the ratio of the sizes of the areas of the pistons 36 and 38. The input 32 is connected to the closing line 26 and when it receives pressure, the booster 30 will provide an increased fluid pressure at the output port 34 which is connected to the close port 18 of the BOP 14.

Valve means are provided to automatically admit operating pressure from the hydraulic supply 20 to actuate the pressure intensifier or booster 30 when the supply pressure in line 20 increases a predetermined amount and at the same time block the normal flow path through the line 26 to the close port 18. Thus, a pilot operated three-way normally closed two-position valve 50 may be provided connected between the close line 26 and the input 32 to the pressure booster 30. An actuating valve, which may be a relief valve 52, is connected between the close line 26 and the pilot 52 of the valve 50. The valve 60 is normally closed but upon the supply pressure in the line 26 reaching a predetermined value, such as 1800 psi, the valve 60 will open transmitting fluid to the pilot 52 of the valve 50 which will then switch valve 50 to the on position to supply hydraulic fluid to the input 32 of the pressure booster 30 at whatever pressure is in the hydraulic supply line 20. A check valve 62 is in parallel with the valve 60 for dumping pressure from the pilot 52 when it is desired to open the BOP 14.

When the increased fluid pressure from the supply line 20 is supplied to the input 32 of the pressure booster 30, above the predetermined value, the boosted or intensified pressure is provided at the output 34 and at the closing port 18 of the BOP 14 for providing the desired increase closing pressure at the close port 18 for example 5000 psi. A normally open pilot operated check valve 64 is provided in the close line 26 upstream of the connection of the outlet 34 to the close port 18 and downstream of the connection of the valves 50 and 60 to the close line 26. A pilot line 66 is connected to the normally open check valve 64 and the pilot line 66 is connected to the line 48 downstream of the valve 50 and actuates the check valve 64 to the close position upon being energized from the line 48. Relief valve 70 is connected in line 48 to limit the output pressure of booster 30 so not to damage the BOP 14.

In operation, with the control valve 22 in the position shown, transmitting hydraulic fluid from the hydraulic supply line 20 through the close line 26 and through the normally open check valve 64 to the closed port 18 the blowout preventer 12 is actuated towards the close position to the extent of the pressure in the line 20, for example, 1500 pounds. At this time, the valve 60 is closed, the valve 50 is closed, and the pressure booster is inactivated. However, by increasing the pressure of the hydraulic fluid in the line 20 to a predetermined value, such as 1800 psi, the valve 60 will open, actuate pilot 52 and open valve 50 and apply the high pressure through the line 48 to the input 32 of the pressure booster 30. At the same time, the pilot line 66 is actuated to close the check valve 64. The pressure in the hydraulic supply line 20 may be further increased to its limit, for example, 3000 psi which is applied against the piston 36 and is thus multiplied by the smaller piston 38 to a higher pressure, for example, 5000 psi which is applied to the closing port 18 of the BOP 14 thereby providing a sufficient force to actuate shear rams.

However, in order to limit the pressure in the BOP 14, a relief valve 70 is provided which limits hydraulic fluid pressure to the input 32 in the event that the pressure in the line 48 increases too much.

In order to open the BOP 14, the control valve 22 is actuated to connect the hydraulic fluid supply line 20 to the open line 24 and vent the close line 26 to the sump 28. By switching the valve 22 the pressure in the close line 26 upstream of the check valve 64 will decrease, closing the valve 60 and allowing the high pressure on the pilot 52 to diminish through the check valve 62 which in turn closes valve 50 relieving the high pressure at the input 32 of the pressure booster 30 and decreasing the pressure in the pilot line 66 causing the check valve 64 to return to its normally open position. Then as fluid pressure flows through the line 24 into the open port 16 fluid pressure flows out the close port 18 to the sump 28 and line 72 which is connected to the open line 24 may be connected to the pressure booster 30 to retract the pressure booster to its original position.

The method of operating a blowout preventer having a two-way hydraulic piston and cylinder assembly with an open and close port is apparent from the foregoing description of the apparatus of the hydraulic circuit 10. The method includes directing hydraulic fluid from an adjustable hydraulic supply through a normal operating path to the close port for moving the blowout preventer towards the closed position, increasing the adjustable hydraulic supply pressure to a predetermined pressure value, intensifying the predetermined value greater than the supply pressure, and applying the intensified pressure value to the close port while blocking the normal operating path.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts, and steps of the method will readily suggest themselves to those skilled in the art and which are encompassed within the spirit of the invention and the scope of the appended claims.

What is claimed is:

1. A hydraulic control circuit for operating a blowout preventer having a two-way hydraulic piston and cylinder assembly including an open and a close port comprising, an adjustable hydraulic supply, a control valve connected between the hydraulic supply and the open and close ports, a pressure intensifier having an input and an output with the output connected to the close port for providing an increased closing pressure at the close port, and valve means connected to the input of the intensifier and to the close port for actuating the intensifier and blocking flow from the control valve to the close port when the hydraulic supply pressure increases to a predetermined value.

2. The apparatus of claim 1 wherein said valve means includes, a normally closed valve means connected to the input to the intensifier, said normally closed valve openable upon receiving a predetermined hydraulic pressure, and a pilot operated check valve connected between the control valve and said close port.

3. The apparatus of claim 1 wherein the pressure intensifier includes, a first piston connected to a second smaller piston, said piston movable in separate cylinders, said first piston connected to the input and said second piston connected to the output.

4. The apparatus of claim 1 including, a relief valve connected to the input to the intensifier for limiting the pressure applied to the close port.

5. A hydraulic control circuit for operating a blowout preventer having a two-way hydraulic piston and cylinder assembly including an open and a close port comprising, an adjustable hydraulic supply, a control valve connected between the hydraulic supply and the open and close ports, a pressure booster having an input and an output, said output connected to the close port, said booster including a first piston connected to a second smaller piston, said pistons movable in separate cylinders, said first piston connected to the input and said second piston connected to the output, a normally closed valve connected between the control valve and the input of the booster, said normally closed valve openable upon receiving a predetermined hydraulic pressure, and a pilot operated check valve connected between the control valve and said close port.

6. A method of operating a blowout preventer having a two-way hydraulic piston and cylinder assembly with an open and close port comprising, directing hydraulic fluid from an adjustable hydraulic supply through a normal operating path to said close port for moving the blowout preventer toward the closed position, increasing the adjustable hydraulic supply pressure to a predetermined pressure value, intensifying the predetermined pressure value greater than said supply pressure, applying the intensified pressure value to said close port while blocking the normal operating path.

7. The method of claim 6 wherein the pressure is intensified by applying the supply pressure to a first piston which is connected to a smaller second piston which intensifies the supply pressure.

* * * * *